United States Patent [19]

Sullivan

[11] Patent Number: 4,856,672

[45] Date of Patent: Aug. 15, 1989

[54] CONDENSATION PAN/CONVERTER TRAY FOR A FAN COIL UNIT

[76] Inventor: John Sullivan, 3910 Madison St., Hyattsville, Md. 20781

[21] Appl. No.: 251,602

[22] Filed: Sep. 30, 1988

[51] Int. Cl.[4] ..... B65D 6/10

[52] U.S. Cl. ..... 220/82; 220/1 C; 220/DIG. 6

[58] Field of Search ..... 220/83, 1 C, DIG. 6

[56] References Cited

U.S. PATENT DOCUMENTS

| | | | |
|---|---|---|---|
| 4,114,644 | 9/1978 | Piper | 220/1 C |
| 4,315,561 | 2/1982 | Partridge | 220/1 C |
| 4,727,904 | 3/1988 | Lease | 220/1 C |

OTHER PUBLICATIONS

"Introducing CAPCO's New Convector Trays." (advertisement).

*Primary Examiner*—Joseph Man-Fu Moy

*Attorney, Agent, or Firm*—Diller, Ramik & Wight

[57] ABSTRACT

A convector tray including a tray body constructed from polymeric/copolymeric material, the tray body including a bottom wall and upstanding peripheral wall collectively defining a condensation chamber, openings for effecting the passage of air through the bottom wall upon the utilization of the convector tray with an associated fan coil unit, a rigid elongated reinforcing/rigidifying member positioned within the condensation tray along the bottom wall for reinforcing/rigidifying the tray body, and a plurality of condensate passages for conducting condensate generally transverse across the bottom wall and across and beneath the reinforcing-/rigidifying member whereby condensate upon the bottom wall will be conducted by the condensate passages toward a drain area to prevent rust, blockage, and fungus growth, and with the elimination of attendant overflow and damage.

20 Claims, 2 Drawing Sheets

CONDENSATION PAN/CONVERTER TRAY FOR A FAN COIL UNIT

BACKGROUND OF THE INVENTION

Residential and commercial air conditioners include as a part thereof a fan coil unit. The fan coil unit includes a coil through which coolant (liquid or gas) is pumped, and normally the coil is above a condensation pan or convector tray having one or more openings through which air is blown by one or more fans. The air passing through the coil creates condensation on the coil which drips down upon the convector tray and then is conducted by an appropriate outlet and pipe to a drain.

Such convector trays are generally made from galvanized metal and rust with relative ease. Once a convector tray rusts the water might, for example, drip down and into the underlying motor(s) which drives the fan(s), causing the latter to shortout. Continuing rust also blocks or reduces normal drainage which results in fungus growth which in turn can also cause odors and also cause the normal drain opening to close or appreciably block the same with, of course, attendant overflow and damage.

SUMMARY OF THE INVENTION

The present invention is directed to a condensation pan or convector tray for fan coil units of air conditioners/heat exchangers and includes a generally elongated tray body constructed from a single piece of in situ molded polymeric/ copolymeric material. The tray body includes a bottom wall and an upstanding peripheral wall defining a condensation chamber. An opening bounded by a peripheral wall is formed in the bottom wall to effect the passage of air through the bottom wall when the convector tray is utilized with an associated fan coil unit of a heat exchanger. A relatively rigid elongated member is connected to the bottom wall of the convector tray to reinforce the same, particularly since the tray body is constructed from relatively flexible though impact resistant material, such as flexible polyethylene, high-impact polystyrene or ABS. The reinforcing member prevents the entire tray body from twisting or flexing while reducing the overall weight thereof, particularly as compared to the weight of a conventional galvanized tray. Also, an important part of the invention is the provision of a plurality of condensate passages or channels integrally formed in the bottom wall of the tray body which open in opposing relationship to the reinforcing member and permit condensate to drain through the passages or channels toward a main discharge or drain opening. These plurality of condensate passages prevent condensate from building up in the condensation chamber of the tray body which might otherwise overflow and/or cause the growth of fungus which is highly detrimental because of the tendency thereof to block drain passages/openings, create overflow and attendant mildew and its accompanying odor.

With the above and other objects in view that will hereinafter appear, the nature of the invention will be more clearly understood by reference to the following detailed description, the appended claims and the several views illustrated in the accompanying drawing.

DESCRIPTION OF THE PREFERRED EMBODIMENT

Figures 1, 4, 5:
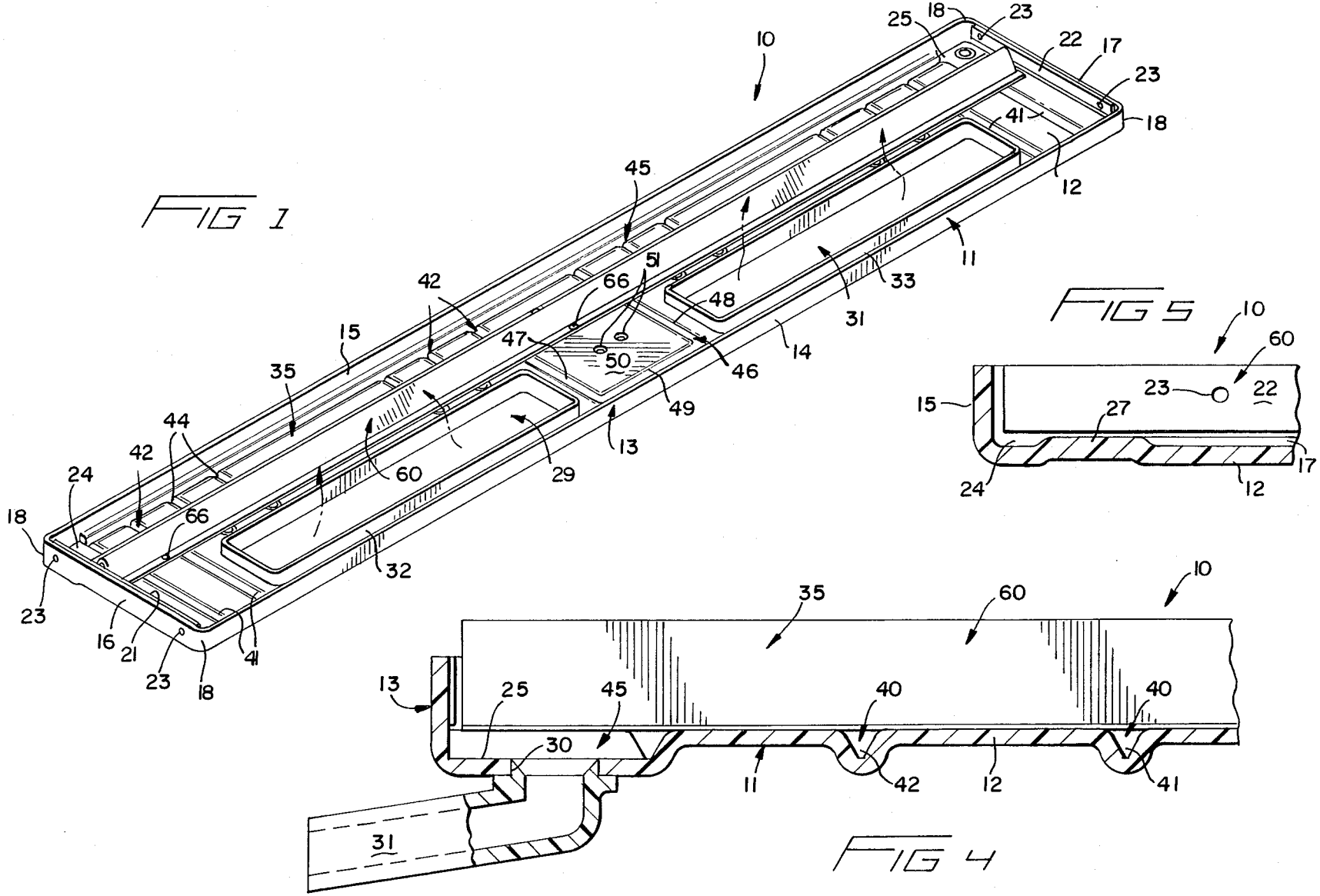
FIG. 1 is a top perspective view of a novel convector tray or a condensation pan constructed in accordance with this invention, and illustrates a tray body formed of polymeric/copolymeric in situ molded material having a bottom wall, two openings in the bottom wall, peripheral walls bounding the bottom wall and the openings therein, condensate channels in the bottom wall and an elongated reinforcing member along the bottom wall for rigidifying/reinforcing the convector tray.
FIG. 4 is an enlarged fragmentary sectional view taken generally along line 4—4 of FIG. 3, and illustrates the elongated reinforcing member and condensate passages bridged thereby.
FIG. 5 is an enlarged fragmentary sectional view taken generally along line 5—5 of FIG. 3, and illustrates a drain area of the tray provided with a circular portion which is removed to form a drain opening in the main drain channel, as illustrated in FIG. 2.

A novel convector tray or condensation pan constructed in accordance with this invention is generally designated by the reference numeral 10 and includes a relatively elongated tray body 11 constructed from in situ vacuum molded polymeric/copolymeric material, such as high-impact polystyrene, flexible polyethylene or impact-resistant ABS. The latter materials eliminate rust build-up and reduce drain and condensate passage/channel clogging due to mineral deposits and fungus growth. wall 12 and an upstanding peripheral wall 13. The upstanding peripheral wall 13 includes generally parallel side walls 14, 15 (FIGS. 1 and 3) and end walls 16, 17. Integral rounded corners 18 connect the various adjacent walls 14–17 to each other and definen therewith and with the bottom wall 12 relatively smooth transition surfaces which prevent the accumulation of water, debris, etc. A reinforcing strip 21, 22 is connected to and inboard of the respective end wall 16, 17. The reinforcing strips or members are preferably constructed from aluminum or like relatively non-corroding metallic material, and each is appropriately connected to the associated end wall 16, 17 by conventional plastic or relatively noncorrosive (aluminum/copper, etc.) rivets or like fasteners 23.

Figure 3:
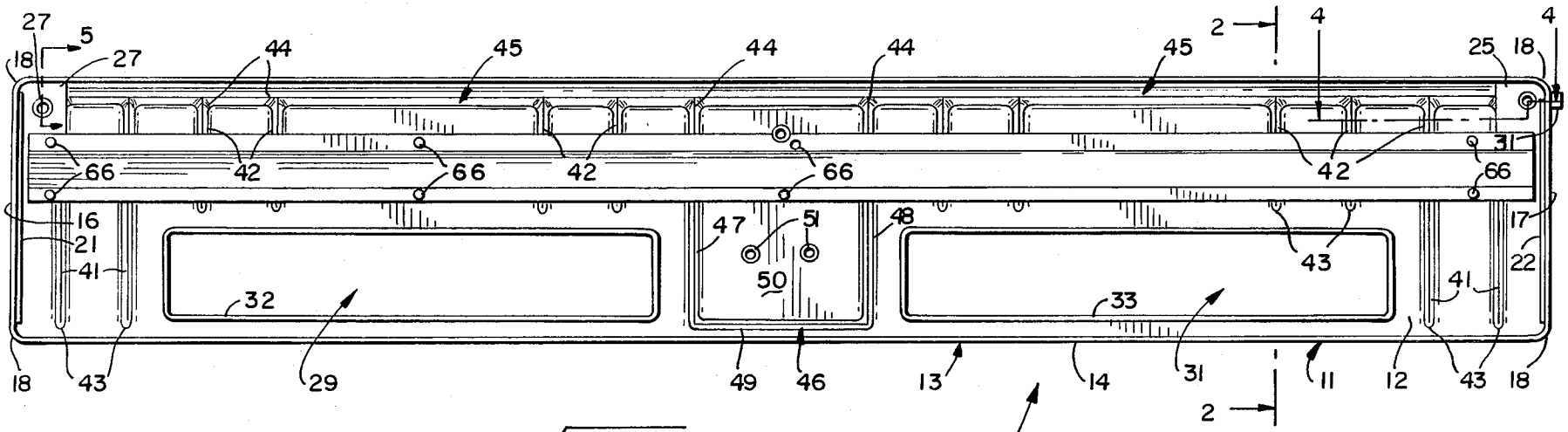
FIG. 3 is a top plan view of the convector tray and illustrates further details thereof.

A drain area 24, 25 is located at a lowermost portion of the bottom wall 12 (FIGS. 1 and 2) at the corners defined by the intersection of the walls 15, 16 and 15, 17. At each drain area or drain portion 24, 25 the bottom wall is provided with an upstanding wall portion 27 (FIGS. 3 and 5) which is of a generally circular configuration, as viewed in top plan (FIG. 3). The two wall portions 27 are provided at the drain areas 24, 25 so that either or both can be cut away and removed to form a drain opening 30 (FIG. 2) into which is inserted and bonded by an appropriate adhesive a discharge or drain pipe 31 (FIG. 2). Depending upon the construction of a particular heat exchanger/fan coil unit, the condensate which drains into the convector tray 10 will discharge to an appropriate drain through the drain pipe 31, and the provision of the wall portion 27 at opposite drain areas 24, 25 allows the selective connection of a drain pipe 31 thereto. This is of particular importance when the convector tray 10 functions as a replacement for a conventional galvanized tray which may have been deteriorated and must be removed and replaced. The galvanized tray might have a drain opening in either of its corners, and by supplying the convector tray 10 without any drain opening but with the circular wall portions 27 at both drain areas 24, 25, the person replacing the worn/leaking galvanized convector tray can match its drain opening by selectively removing one of the wall portions 27 from either of the drain areas 24, 25 and, of course, forming the drain opening 30 therein (FIG. 2).

The bottom wall 12 also includes a pair of relatively rectangular openings 29, 31 for effecting the passage of air through the bottom wall 12 upon the utilization of the convector tray 10 with an associated fan coil unit of a heat exchanger/air conditioner. The convector tray 10 is normally positioned between a coil positioned above the convector tray 10 and one or more fans positioned beneath the convector tray 10 which have outlets connected to the openings 29, 31. Air moving upwardly through the openings 29, 31, as indicated by the broken headed arrows associated therewith in FIGS. 1 and 2, flows through the coil of the fan coil unit, condenses, and the condensation falls into, collects upon, and drains from the convector tray 10. Upstanding peripheral walls 32, 33 bound the respective openings 29, 31 and prevent condensate/water from flowing through the openings 29, 31 downwardly through the bottom wall which would otherwise occur in the absence of the peripheral walls 32, 33. Thus, the bottom wall 12 and the peripheral walls 13, 30 and 33 collectively define a condensation chamber 35 in which condensate is collected and drains therefrom in the manner heretofore noted.

Figure 2:
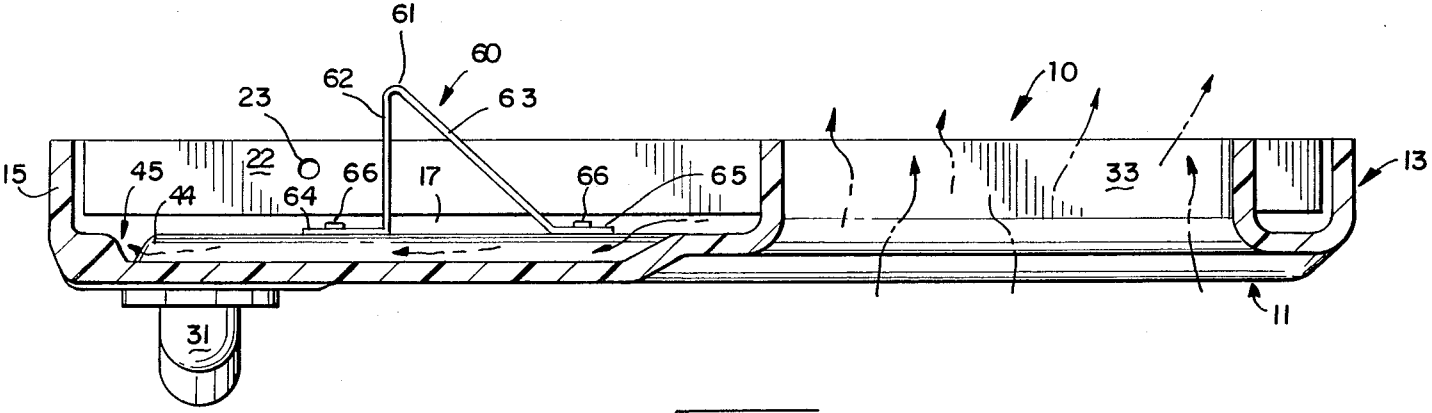
FIG. 2 is an enlarged fragmentary cross sectional view taken generally along line 2—2 of FIG. 3, and illustrates a pair of the condensate channels or passages, the reinforcing element, a main drain channel and a discharge pipe through which condensate/water drains from the main drain channel of the convector tray.

When the tray body 11 is molded, a plurality of condensate passage means, passages or channels 40 are in situ molded in the bottom wall 12 for conducting condensate generally transversely across the bottom wall in a direction generally from the side wall 14 toward the side wall 15, as is most readily apparent from FIGS. 1, 2 and 3 of the drawings. All of the condensate passages or channels 40 open upwardly (FIG. 2), and the same vary in length and configuration depending upon the location in the bottom wall 12. Individual condensate channels 41 are relatively long, wherein individual condensate channels 42 are relatively short because of their location relative to the peripheral walls 32, 33, 13, but each is closed at an end 43 (FIGS. 2 and 3) most closely adjacent the side wall 14 and open at an end 44 (FIGS. 2 and 3) most closely adjacent the side wall 15. Thus, condensate/water which collects in the passages 41, 42 flows from the closed ends 43 toward the open ends 44 and into a main drain pasasge 45. The main drain passage or channel 45 runs the length of the tray body 11 between the drain areas 24, 25 (FIGS. 1 and 3).

A generally U-shaped condensate passage or channel 46 is located between the peripheral walls 32, 33 and is set-off by a generally parallel pair of channel portions 47, 48 and a bight channel portion 49 therebetween. The channel portions 47, 48 likewise open at 44 (FIG. 3) into the main drain passage 45. Hence, any condensate/water accumulating in the U-shape condensate passage or channel 46 will likewise flow into the main drain passage 45.

A central wall portion 50 (FIGS. 1 and 3) within the general outline of the U-shaped condensate passage 46 is provided with circular wall portions 51 corresponding to the circular wall portion 27 at the drain areas 24, 25. These wall portions 51 are also located to facilitate the removal thereof for particular installations in which a center-located drain pipe is desired, as opposed to a drain pipe at either of the drain areas 24, 25 or as an augment thereto.

Means, generally designated by the reference numeral 60 is positioned within the condensation chamber 35 along and is connected to the bottom wall 12 thereof for reinforcing and rigidifying the tray body 11. The reinforcing means 60 is preferably an elongated member formed from aluminum or similar corrosion resistant metallic material which is positioned generally parallel to the side walls 14, 15 and is defined by a radius 61, a pair of angularly related arms or legs 62, 63, and respective flanges or feet 64, 65 (FIG. 4). The flanges or feet 64, 65 rest upon the bottom wall 12 and are connected thereto by conventional noncorrosive metallic or plastic fasteners or rivets 66. As was heretofore noted, while the tray body 11 is constructed from relatively high-impact/impact resistant polymeric/copolymeric material, it would otherwise tend to deflect, bend or torque in the absence of some type of reinforcement, and the latter is precluded by the reinforcing and rigidifying member 60. Furthermore, the reinforcing member 60 spans and is spaced above all of the condensate passages or channels 40 which, of course, open upwardly toward the reinforcing member 60. Furthermore, the reinforcing member 60 is positioned between the ends 43, 44 of each of the passages of channels 40, and is best illustrated in FIG. 2, which assures that any water which collects in the tray body 11 upon the bottom wall 12 will flow along the channels or passages 40 into the main drain channel 45. The latter unobstructed flow is represented by the broken unnumbered headed arrows in FIG. 2. Thus, not only is free flow provided over the entire surface area of the bottom wall 12, but because the tray body 11 is constructed from noncorrosive material and the reinforcing member 60 is formed from relatively low-corrosive metallic material, rust and/or mineral deposits and or fungus growth is virtually eliminated or highly precluded, and the free flow designated in FIG. 4 for the condensate is maintained virtually over an extended lifetime of the convector tray well in excess of that heretofore provided by galvanized metallic convector trays. In this manner, rust buildup, fungus growth and mineral deposits are precluded to a large extent, drain-clogging is reduced and tray body corrosion and attendant leaking is virtually eliminated.

Although a preferred embodiment of the invention has been specifically illustrated and described herein, it is to be understood that minor variations may be made in the apparatus and the method without departing from the spirit and scope of the invention, as defined in the appended claims.

I claim:

1. A convector tray comprising a tray body constructed from polymeric/copolymeric material, said tray body including a bottom wall and an upstanding peripheral wall collectively defining a condensation chamber, means for effecting the passage of air through said bottom wall upon the utilization of said convector tray with an associated fan coil unit, means positioned within said condensation chamber along said bottom wall for reinforcing/rigidifying said tray body, and condensate passage means for conducting condensate generally transversely across said bottom wall and across and beneath said reinforcing/ rigidifying means whereby condensate upon said bottom wall will be conducted by said condensate passage means toward a condensate drain area.

2. The convector tray as defined in claim 1 wherein said reinforcig/rigidifying means is a generally elongated member.

3. The convector tray as defined in claim 1 wherein said condensate passage means includes at least one upwardly opening channel in said bottom wall opening in an upward direction toward said reinforcing/rigidifying means.

4. The convector tray as defined in claim 1 wherein said condensate package means includes at least one upwardly opening channel in said bottom wall opening in an upward direction toward said reinforcing/rigidifying means, and said reinforcing/ rigidifying means is in spanning relationship to said at least one upwardly opening channel.

5. The convector tray as defined in claim 1 wherein said reinforcing/rigidifying means is a generally elongated member angled in transverse cross section.

6. The convector tray as defined in claim 1 wherein said reinforcing/rigidifying means is a generally elongated metallic member angled in transverse cross section.

7. The convector tray as defined in claim 1 wherein said reinforcing/rigidifying means is a generally elongated member bent upon itself to define at least two legs in angled relationship to each other to collectively form a reinforcing channel bar, and means for securing said reinforcing channel bar to said bottom wall.

8. The convector tray as defined in claim 1 wherein said tray body is a single in situ molding of said polymeric/copolymeric material.

9. The convector tray as defined in claim 1 including another upstanding peripheral wall bounding said air passage effecting means.

10. The convector tray as defined in claim 1 wherein said air passage effecting means is an opening in said bottom wall, and another upstanding peripheral wall bounding said opening.

11. The convector tray as defined in claim 1 including a generally circular wall portion in said condensate drain area which is adapted to be removed to form a drain opening in said bottom wall.

12. The convector tray as defined in claim 1 wherein said tray body is of a relatively elongated construction, said reinforcing/rigidifying means extends generally in the lengthwise direction of said tray body, and said condensate passage means extends generally in the widthwise direction of said tray body.

13. The convector tray as defined in claim 1 wherein said reinforcing/rigidifying means is a generally elongated member bent upon itself to define at least two legs in angled relationship to each other to collectively form a reinforcing channel bar, means for securing said reinforcing channel bar to said bottom wall, and said channel bar securing means being defined by a flange carried by each leg and fastener means for securing said flanges to said bottom wall.

14. The convector tray as defined in claim 2 wherein said condensate passage means includes at least one upwardly opening channel in said bottom wall opening in an upward direction toward said reinforcing/rigidifying means, and said reinforcing/ rigidifying means is in spanning relationship to said at least one upwardly opening channel.

15. The convector tray as defined in claim 3 wherein said tray body is a single in situ molding of said polymeric/copolymeric material.

16. The convector tray as defined in claim 15 including another upstanding peripheral wall bounding said air passage effecting means.

17. The convector tray as defined in claim 15 including a generally circular wall portion in said condensate drain area which is adapted to be removed to from a drain opening in said bottom wall.

18. The convector tray as defined in claim 15 wherein said air passage effecting means is an opening in said bottom wall, and another upstanding peripheral wall bounding said opening.

19. The convector tray as defined in claim 16 including a generally circular wall portion in said condensate drain area which is adapted to be removed to form a drain opening in said bottom wall.

20. The convector tray as defined in claim 16 wherein said air passage effecting means is an opening in said bottom wall, and another upstanding peripheral wall bounding said opening.

* * * * *